US006923714B1

(12) United States Patent
Zuniga et al.

(10) Patent No.: US 6,923,714 B1
(45) Date of Patent: Aug. 2, 2005

(54) CARRIER HEAD WITH A NON-STICK MEMBRANE

(75) Inventors: Steven M. Zuniga, Soquel, CA (US); Hung Chih Chen, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/943,296

(22) Filed: Sep. 17, 2004

Related U.S. Application Data

(63) Continuation of application No. 10/033,581, filed on Dec. 27, 2001, now abandoned.

(51) Int. Cl.[7] ..... B24B 7/22
(52) U.S. Cl. ..... 451/289; 451/285; 451/388; 451/398
(58) Field of Search ..... 451/41, 388, 285–290, 451/398

(56) References Cited

U.S. PATENT DOCUMENTS 5,624,299 A 4/1997 Shendon
6,056,632 A * 5/2000 Mitchel et al. ..... 451/288
6,113,466 A * 9/2000 Lin ..... 451/41
6,165,058 A 12/2000 Zuniga et al.
6,183,354 B1 2/2001 Zuniga et al.
6,315,649 B1 * 11/2001 Hu et al. ..... 451/285
6,508,696 B1 * 1/2003 Kobayashi et al. ..... 451/288
6,627,098 B2 * 9/2003 Custer et al. ..... 216/88

OTHER PUBLICATIONS

Brooks, A., "Surface Enhancement of Elastomers Using a Polymer Film", Sep. 21-24, 1999, Rubber Division, American Chemical Society, Orlando, Florida, Paper No. 16, pp. 1-8.

* cited by examiner

*Primary Examiner*—Lee D. Wilson
*Assistant Examiner*—Anthony Ojini
(74) *Attorney, Agent, or Firm*—Fish & Richardson

(57) ABSTRACT

A carrier head for chemical mechanical polishing of a substrate includes a base and a flexible membrane extending beneath the base to define a chamber. The flexible membrane has a core of a first material and an outer layer of a second material having a lower adhesion to the substrate than the first material. An exposed surface of the outer layer provides a mounting surface for the substrate.

19 Claims, 1 Drawing Sheet

CARRIER HEAD WITH A NON-STICK MEMBRANE

CROSS-REFERENCE TO RELATED APPLICATIONS

This application is a continuation application and claims the benefit of priority under 35 U.S.C. Section 120 of U.S. application Ser. No. 10/033,581, filed on Dec. 27, 2001 now abandoned.

BACKGROUND

The present invention relates generally to chemical mechanical polishing of substrates, and more particularly to a carrier head for chemical mechanical polishing a substrate.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically reactive agent, and abrasive particles, if a standard pad is used, is supplied to the surface of the polishing pad.

Some carrier heads include a flexible membrane that applies a load to substrate. After polishing, the flexible membrane provides a mounting surface for the substrate while the substrate is vacuum-chucked to the carrier head, lifted off the polishing pad and moved to another location, such as a transfer station or another polishing pad.

SUMMARY

In one aspect, the invention is directed to a carrier head for chemical mechanical polishing of a substrate. The carrier head has a base and a flexible membrane extending beneath the base to define a chamber. The flexible membrane provides a mounting surface against which a substrate may be positioned, and the mounting surface includes a low adhesive material to which the substrate does not readily adhere.

In another aspect, the invention is directed to a carrier head for chemical mechanical polishing of a substrate. The carrier head includes a base and a flexible membrane extending beneath the base to define a chamber. The flexible membrane includes a core of a first material and an outer layer of a second material having a lower adhesion to the substrate than the first material. An exposed surface of the outer layer provides a mounting surface for the substrate.

Implementations of the invention may include one or more of the following features. The first material may be an elastomer and the second material may be a polymer. A thickness of the outer layer may be between about 0.1 and 2.0 microns. A coefficient of friction of the mounting surface against the substrate may be less than about 0.5. The second material may be deposited on the first material, e.g., by gas phase polymerization coating. The second material may be deposited on selected portions of the first material to form a pattern.

In another aspect, the invention is directed to a carrier head for chemical mechanical polishing of a substrate. The carrier head has a base and a flexible membrane extending beneath the base to define a chamber. The flexible membrane includes an inner portion formed of a first material and an outer portion formed of a second material. The outer portion provides a mounting surface against which a substrate may be positioned. The second material has a lower adhesion to the substrate than the first material.

In another aspect, the invention is directed to a flexible membrane for a carrier head. The flexible membrane has core of a first material and an outer layer of a second material formed over the core. An exposed surface of the outer layer provides a mounting surface for a substrate. The second material has a lower adhesion to the substrate than the first material.

The flexible membrane defines a pressurizable chamber within the carrier head and includes a low adhesion material to which the substrate does not readily adhere.

The details of one or more implementations of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

As noted above, some carrier heads include a flexible membrane that provides a mounting surface while the substrate is moved to a new location. To unload the substrate from the carrier head at a new location, the membrane must release the substrate. Unfortunately, the unloading procedure may occasionally fail. Therefore, there is a need for a polishing apparatus which enables reliable unloading to improve the polishing throughput while decreasing the risk of destruction or contamination of the substrate.

Figure 1:
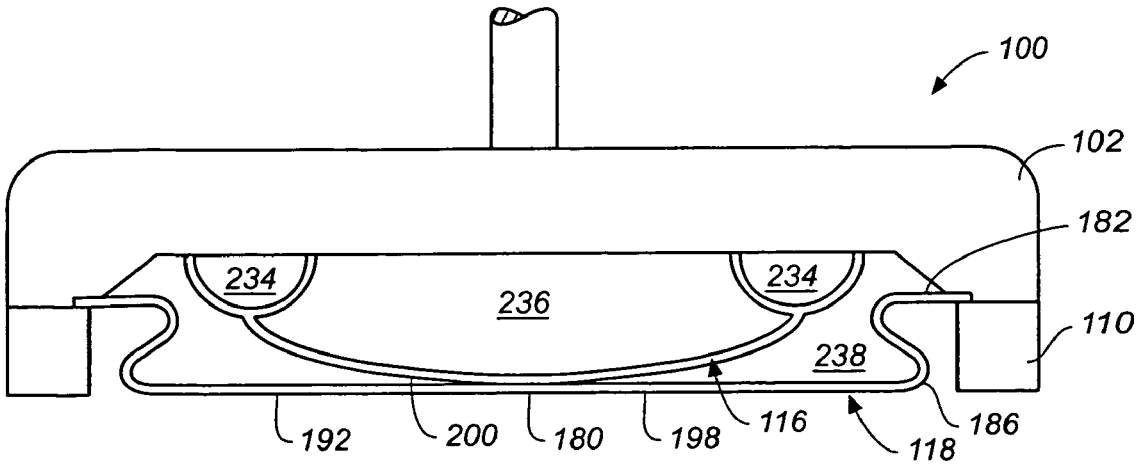
FIG. 1 is a cross-sectional view of a carrier head that includes a flexible membrane.

Referring to FIG. 1, one or more substrates 10 will be polished by a chemical mechanical polishing (CMP) apparatus that includes a carrier head 100. A description of a suitable CMP apparatus may be found in U.S. Pat. No. 5,738,574, the entire disclosure of which is incorporated herein by reference.

The carrier head 100 includes a housing 102, a retaining ring 110, a flexible internal membrane 116, and a flexible external membrane 118. The internal membrane 116 and external membrane form two upper chambers 234 and 236 and an lower chamber 238. The carrier head 100 may be constructed as described in U.S. patent application Ser. No.

09/470,820, filed Dec. 23, 1999, the entire disclosure of which is incorporated by reference. Although unillustrated, the carrier head may also include a base assembly that is vertically movable relative to the housing 102, a gimbal mechanism (which may be considered part of the assembly) that permits the base to pivot, and a loading chamber between the base and the housing.

The external flexible membrane 118 is a generally circular sheet formed of a flexible and elastic material, such as chloroprene, ethylene propylene rubber or silicone. External flexible membrane 118 can include an inner portion 180 with an outer surface 192, which provides a receiving surface 198 or mounting surface for a substrate, an annular edge portion 182 which extends to be clamped between the retaining ring 110 and the base 104. The external membrane 118 can also include a flexible lip portion 186 to provide an active-flap lip seal during chucking of the substrate as discussed in U.S. Pat. No. 6,210,255, the entire disclosure of which is incorporated by reference. The bottom surface of a central portion 200 of the internal membrane 116 may be textured, e.g., with small grooves, to ensure that fluid can flow between the internal and external membranes when they are in contact.

Figure 2:
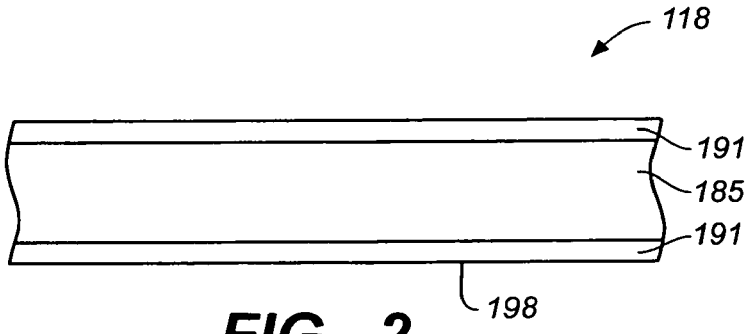
FIG. 2 is a cross-sectional view of the flexible membrane from FIG. 1.

Referring to FIG. 2, the external flexible membrane 118 can have multiple sections, including a core section 185 and an outer layer 191. The core section 185 of the external flexible membrane 118 can be formed of a first material, and the outer layer 191 can be formed of a second, different material. The core section 185 can extend through the inner portion 180, the annular edge portion 182 and the flexible lip portion 186. The outer layer 191 can be formed on the entire core section 185, so that the second material of the outer layer covers all portions of the outer surface of the core section 185. Alternatively, the outer layer 191 can be formed just on the outer surface 192 of the inner portion 180. In either case, the portion of the outer layer 191 covering the inner portion 180 forms a low adhesive substrate receiving surface 198 for mounting of the substrate.

The core section 185 of the external flexible membrane 118 can be formed of a flexible and elastic material, such as chloroprene or ethylene propylene rubber, or silicone. Materials used for the flexible membrane can be high molecular-weight elastomer compounds prepared from ethylene and propylene monomers (ethylene propylene co-polymers). For some flexible membranes it may be appropriate to add a small amount of a third monomer (ethylene propylene terpolymers).

Generally, elastomers possess the elasticity and high sealing capability required for the proper performance of the flexible membrane. However, rubber and elastomer components can contain plastisizers or other mobile components, such as oxygen, nitrogen, or sulfur atom links in their carbon backbone structures. Particularly in the context of nitrogens, oxygens and like, some atoms can have extra, or "free", electrons. Without intending to be limited to any particular theory, when an elastomer comes in contact with another material which has an atomic structure with "holes", the extra electrons of the elastomers tend to move to fill these holes. Thus, the free electrons tend to oscillate back and forth, and are actually partially shared between the two materials. This results in high adhesion properties at the junction of the two materials and, consequently, in a high coefficient of friction. Typically, adhesive elastomers have a coefficient of friction in the range of 1.5 to 2.0 against dry steel.

As discussed above, a substrate is typically formed on a p-type silicon wafer by the sequential deposition of conductive, semiconductive, and insulative layers. The atomic backbone structure of the p-type silicon has "holes", which, as discussed above, facilitate bonding interactions with the extra electrons of the elastomer in the flexible membrane.

Typically, a silicon layer of a substrate that is undergoing the CMP process is covered with either a deposited oxide layer or a native oxide layer. Since the oxide layer interferes with the substrate performance, the substrate is cleaned with chemical solutions and solvents (e.g., HF cleaning) to remove the oxide. During the HF cleaning, the native oxide layer is stripped from the back surface of the silicon wafer. Subsequently, as will be discussed in detail below, the back surface of the substrate contacts the elastomer of the flexible membrane. Since, as explained above, both materials in contact are highly conducive to sharing electrons, a bonding interaction tends to occur at the junction between the two materials. Consequently, after cleaning, the friction forces between the substrate and the flexible membrane are substantially stronger than prior to cleaning.

In addition, the adhesive forces can impede the subsequent detachment of the substrate from the flexible membrane. If the adhesion forces holding the substrate on the membrane mounting surface are greater than the gravity force from the weight of the substrate, then, despite the unloading pressure, the substrate remains on the carrier head when the carrier head retracts from the transfer station. When a new wafer is loaded, both substrates can fracture or chip. If any one substrate develops a fracture, a broken piece of the substrate may come loose and destroy all other substrates being polished on the same pad. Furthermore, a partially detached substrate can cause an error in which the system is unable to locate the substrate.

Failure to remove the substrate can cause a machine fault that requires manual intervention. Both the removal of the substrate and replacement of the flexible membrane require shutting down the polishing apparatus, decreasing throughput. To achieve reliable operation from the polishing apparatus, the substrate removal process should be essentially flawless.

To reduce the problem of the membrane stickiness, the outer layer 191 of the external flexible membrane 118 can be formed of a material with a molecular makeup that makes the outer layer less adhesive or "tacky" than the material in the core section 185. The material of the outer layer 191 should not be readily adhesive. In particular, the surface stickiness of the outer layer 191 should be sufficiently low to allow for easy and unrestrained detachment of the substrate from the flexible membrane in response to pressure changes in chambers 234, 236 and 238. In addition, the outer layer 191 should be hydrophobic, durable, and chemically inert vis-à-vis the polishing process.

One manner of gauging the "tackiness" of the flexible membrane is to measure the coefficient of friction against several standard materials. The material of the outer layer 191 should have a friction coefficient less than 1 against the backside of the substrate. Preferably, the coefficient of friction of the bottom surface 198 does not exceed about 0.5 against the backside of the substrate. The coefficient of friction can be in the range of about 0.2 to 0.4 as measured under test ASTM D 1894.

In operation, when the substrate is delivered to the location at which the unloading of the substrate from the carrier head is required, the upper chambers 234 and 236 are vented or depressurized to lift away from the substrate, and the outer chamber 238 is pressurized so that the external flexible membrane 118 tends to bow outwardly. At that point, the reduced stickiness of the outer layer 191 improves the likelihood that the bottom surface 198 will detach from the substrate, so that the seal is broken and the substrate is no longer vacuum-chucked to the carrier head.

On the other hand, the material of the outer layer should also possess sufficient elasticity that it does not degrade the functional performance of the membrane. Specifically, the material of the outer layer 191 should be elastic and flexible enough to readily form a seal with the substrate in response to a negative pressure change in the chamber 238. In addition, the outer layer 191 should be sufficiently flexible that the membrane will conform to the back surface of the substrate. For example, the outer layer may have an elongation to break in the range of about 30 to 50 percent.

The thickness of the outer layer can be selected so that the external flexible membrane 118 can maintain its elasticity, flexibility and conformability to the substrate. The outer layer 191 needs to be sufficiently small that it does not degrade the functional performance of the flexible membrane. On the other hand, the thickness needs to be sufficiently large to effectively modify the surface properties of the membrane. The thickness of the outer layer 191 can be in range starting of about 0.1 to 2 microns. For example, the thickness of the outer layer 191 can be within the range between 0.4 and 0.7 microns. The thickness of the outer layer 191 can be less than 0.5 microns.

The material of the outer layer 191 can be deposited as a polymer film on the top surface of the membrane core 185. As discussed, the chemical structure of the material of the outer layer determines its performance capabilities for the flexible membrane coating application. The absence of polar entities ("free" electrons and "holes") in the essential molecular makeup of some polymers makes polymer film coatings adhesion-free, hydrophobic, stable and resistant to chemical attack. Consequently, the outer layer 191 is able to seal and protect elastomer of the membrane, in addition to modifying it surface properties, particularly, reducing its stickiness. At the same time, a polymer film of the outer layer 191 establishes a barrier that can prevent the high-molecular weight elastomer of the core segment 185 from losing its integrity. Furthermore, the outer layer 191 can prevent plasticizers and other additives used in the manufacture of the core 185 from leaching out into the polishing solution.

A polymer film suitable for the outer layer 191 is polyparaxylylene, known generically as Parylene, and available from Specialty Coating Systems, Inc., of Indianapolis, Ind. Parylene has static and dynamic coefficients of friction which range from 0.25 to 0.33 under test ASTM D 1894.

The chemical structure of Parylene is a crystalline form. Parylene has high molecular weight and an all-carbon backbone. In contrast to other polymeric coating systems that may contain, fillers, stabilizers or other atomically mobile components, the Parylene film coating can reduce tack and surface stickiness of the underlying elastomer of the flexible membrane without adding stiffness to it. In addition, the Parylene film coating can act as a barrier to prevent plasticizers and other additives to the elastomer core 185 from leaching out. The Parylene film can also prevent outside chemicals from attacking the elastomer core 185.

Parylene's elasticity is sufficient for the outer layer 191 to handle substantial changes in length and shape of the flexible membrane without fracturing. The thickness of the Parylene coating can range between 0.1 microns and 2 mils. Three conventional forms of Parylene include Parylene N, C and D, each of which is suitable for performing the functions of the outer layer 191.

The Parylene outer layer 191 may be manufactured by a gas phase polymerization process which is conducted in an evacuated deposition chamber using high-purity powdered raw material. The dry raw material (diparaxylylene powder) is first vaporized at approximately 150 C at a pressure of 1.0 torr. The resulting gas then is heated in a second zone to 680 C at 0.5 torr of pressure to form paraxylene. Paraxylene, a highly reactive tetraolefinic monomeric gas, then is introduced to the deposition chamber at room temperature and 0.1 torr pressure, where it spontaneously polymerizes and deposits as a conformal film on an exposed surface of the flexible membrane. The gas phase polymerization process has no liquid phase. The thickness of the film buildup on the membrane from the gas phase polymerization is related to the dwell time in the vacuum chamber and can be controlled accurately to +/−10% of a target value. The parylene coating can be applied to the flexible membrane in a single parylene process cycle, at a typical rate of 0.0002 inches per hour.

As previously discussed, one problem in CMP is that the existing flexible membranes adhere to the surface of the substrate and do not allow the substrate to detach upon the vacuum-dechucking of the flexible membrane. This can significantly impair polishing of the substrate in a chemical mechanical polishing process. However, the outer layer 191 decreases the adhesion of the external flexible membrane 118 to the substrate surface. Thus, the outer layer 191 decreases the adhesion between the flexible membrane and the substrate surfaces and improves the reliability of the unloading procedure.

To unload the substrate from the carrier head, fluid is pumped into the outer chamber 238. The mounting surface of the external flexible membrane 118 bulges outwardly. This breaks the seal between the external flexible membrane 118 and the substrate, causing the flexible membrane to release the hold of the substrate. The continuing downward pressure from the inside of the flexible membrane substrate pushes the substrate away from the flexible membrane. The outer layer 191 reduces adhesion forces between the silicon of the substrate and the external flexible membrane 118, and thus can substantially improves the reliability of the unloading process. The floating chambers 234 and 236 then are vented or depressurized to lift the carrier head away from the substrate.

Another reoccurring problem in CMP is short lifetime of the flexible membrane. However, the outer layer 191 can prevent contamination of the membrane by the highly reactive chemical solutions used in the CMP process. The outer layer 191 establishes a barrier that can prevent the transfer of the substances into the membrane core and thus can prevent degradation of the substrate.

Additionally, since the substrate does not stick to the membrane, the substrate can be free to rotate independently of the carrier head. This can reduce the amount of torque applied to the membrane, thereby reducing the likelihood that the membrane will tear and improving the membrane lifetime.

Another potential advantage of applying the outer layer is that the outer layer can reduces defects in the polished substrates (on both the front side and back side of the substrate). The open molecular structure of a silicone flexible membrane can be contaminated when metal leaches from the mold used to manufacture the membrane. If the membrane is contaminated, then metal can leach from the membrane onto the substrate or into the slurry during the polishing process. However, as discussed above, the barrier of the outer layer 191 seals the membrane, thus reducing the likelihood that contamination will escape.

Still another potential advantage of the outer layer 191 is that the membrane can be less likely to stick to other components in the carrier head. For example, the external flexible membrane 118 can be less likely to stick to the inner flexible membrane 116, or to the retaining ring, thus improving the overall performance of the CMP process.

Another potential advantage is reduced scratching of the internal parts of the CMP apparatus and an improved internal cleanliness of the CMP apparatus. Due to the presence of the outer layer 191, slurry is less likely to stick to the external flexible membrane 118. Thus, it is less likely for the slurry to be carried to other parts of the machine as the external flexible membrane 118 comes in contact with these parts. In addition, the slurry is less likely to dry and coagulate on the membrane to cause the scratching of the substrate.

Another potential advantage is reduced likelihood of breaking the substrate during the unloading procedure. Since the non-stick coating is less adhesive, the carrier head can need less deflection to break the seal between the flexible membrane and the substrate. Consequently, the substrate can undergo less stress during unloading.

Still another potential advantage is that the membrane may be less likely to tear if the substrate slips out from the carrier. Since the membrane is less adhesive, it is less likely to stick to the polishing pad, and consequently is less likely to tear under the lateral forces from the polishing pad.

It may be noted that another mechanism for adhesion of the substrate to the membrane is liquid surface tension. However, by making the membrane coating of a hydrophobic material, liquid debonds from the membrane at low pressure. Since the polishing solution can flow away from the membrane, the liquid surface tension maintaining the substrate on membrane is reduced, thereby making the unloading process more reliable.

The outer layer 191 can cover at least part of the outer surface of the core section 185 of the external flexible membrane 118. For example, the outer layer 191 can be formed only on the mounting surface 192 of the external flexible membrane, while other portions of the flexible membrane will remain uncoated. Alternatively, the outer layer 191 can cover the entire core section 185.

Figure 3:
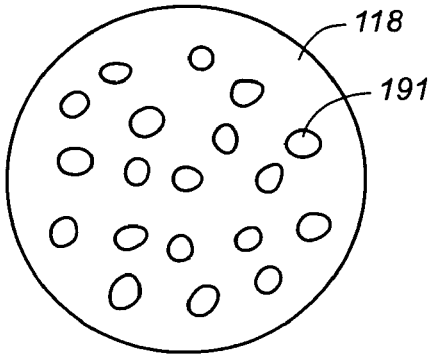
FIG. 3 is a top view of a flexible membrane with a coating over selected portions to form a pattern.

Referring to FIG. 3, in another implementation, the outer layer 191 can be deposited on selected portions of the external flexible membrane 118 to form a pattern of coated and non-coated regions. This can decrease the adhesion forces between the flexible membrane and substrate surfaces while maintaining the high flexibility and elasticity of the membrane. This selective coating can be manufactured by masking the portions of the membrane that do not require coating and depositing the coating on the desired portions of the flexible membrane.

A number of embodiments of the invention have been described. Nevertheless, it will be understood that various modifications may be made without departing from the spirit and scope of the invention. Accordingly, other embodiments are within the scope of the following claims.

What is claimed is:

1. A carrier head for chemical mechanical polishing of a substrate, comprising:

a base; and a flexible membrane extending beneath the base to define a chamber and provide a mounting surface against which a substrate may be positioned, wherein the mounting surface holds the substrate and the mounting surface includes a low adhesive material to which the substrate does not readily adhere.

2. The carrier head of claim 1, wherein:

the mounting surface has a surface stickiness that is sufficiently low to allow for unrestrained detachment of the substrate from the flexible membrane in response to pressure changes in the chamber.

3. A carrier head for chemical mechanical polishing of a substrate, comprising:

a base, and a flexible membrane extending beneath the base to define a chamber, the flexible membrane including a core of a first material and an outer layer of a second material having a lower adhesion to the substrate than the first material, an exposed surface of the outer layer providing a mounting surface that holds the substrate.

4. The carrier head of claim 3, wherein the first material is an elastomer and the second material is a polymer.

5. The carrier head of claim 3, wherein a thickness of the outer layer is between about 0.4 and 0.7 microns.

6. The carrier head of claim 3 wherein a coefficient of friction of the mounting surface against the substrate is less than about 0.5.

7. The carrier head of claim 3, wherein:

the mounting surface has a surface stickiness that is sufficiently low to allow for unrestrained detachment of the substrate from the flexible membrane in response to pressure changes in the chamber.

8. The carrier head of claim 3, wherein the second material is deposited on the first material.

9. The carrier head of claim 8, wherein the second material is deposited on the first material by gas phase polymerization coating.

10. The carrier head of claim 3, wherein the second material is deposited on selected portions of the first material to form a first area including the low adhesive material and a second area free of the low adhesive material.

11. A carrier head for chemical mechanical polishing of a substrate, comprising:

a base; and a flexible membrane extending beneath the base to define a chamber, the flexible membrane including an inner portion formed of a first material and an outer portion formed of a second material, the outer portion providing a mounting surface against which a substrate is positioned such that the outer portion holds the substrate, the second material having a lower adhesion to the substrate than the first material.

12. The carrier head of claim 11, wherein:

the mounting surface has a surface stickiness that is sufficiently low to allow for unrestrained detachment of the substrate from the flexible membrane in response to pressure changes in the chamber.

13. A flexible membrane for a carrier head, comprising:

a core of a first material; and an outer layer of a second material formed over the core, an exposed surface of the outer layer providing a mounting surface for a substrate, wherein the mounting surface holds the substrate and the second material has a lower adhesion to the substrate than the first material.

14. The flexible membrane of claim 13, wherein the first material is an elastomer and the second material is a polymer.

15. The flexible membrane of claim 13, wherein a thickness of the outer layer is between about 0.4 and 0.7 microns.

16. The flexible membrane of claim 13, wherein a coefficient of friction of the mounting surface against the substrate is less than about 0.5.

17. The flexible membrane of claim 13, wherein the second material is deposited on the first material.

18. The flexible membrane of claim 17, wherein the second material is deposited on the first material by gas phase polymerization coating.

19. The flexible membrane of claim 13, wherein the second material is deposited on selected portions of the first material to form a first area having the low adhesive material and a second area free of the low adhesive material.

* * * * *